US005906022A

United States Patent [19]

Ohkawa et al.

[11] Patent Number: 5,906,022

[45] Date of Patent: May 25, 1999

[54] REMOTE CONTROL APPARATUS WITH A CLEANING MECHANISM

[75] Inventors: Takashi Ohkawa; Akio Kirimura; Mitsue Takamori, all of Tokyo, Japan

[73] Assignee: Mitsubishi Denki Kabushiki Kaisha, Tokyo, Japan

[21] Appl. No.: 09/012,984

[22] Filed: Jan. 26, 1998

[30] Foreign Application Priority Data

May 27, 1997 [JP] Japan ..... 9-136723

[51] Int. Cl.[6] ..... A47L 25/00

[52] U.S. Cl. ..... 15/105; 15/106; 15/118; 15/184; 15/185; 15/231; 15/341

[58] Field of Search ..... 15/105, 106, 118, 15/160, 184, 185, 201, 203, 210.1, 231, 341

[56] References Cited

U.S. PATENT DOCUMENTS

| | | | |
|---|---|---|---|
| 1,927,093 | 9/1933 | Ingwersen et al. | 15/184 |
| 3,925,843 | 12/1975 | Tsuruzawa et al. | 15/184 |
| 4,214,340 | 7/1980 | Youngberg et al. . | |
| 5,083,337 | 1/1992 | Jones | 15/118 |
| 5,226,752 | 7/1993 | Guerin et al. | 15/185 |
| 5,436,625 | 7/1995 | Kubo . | |
| 5,561,881 | 10/1996 | Klinger et al. | 15/105 |

FOREIGN PATENT DOCUMENTS

| | | |
|---|---|---|
| U-62-152586 | 9/1987 | Japan . |
| U-6-62690 | 9/1994 | Japan . |
| A-9-51592 | 2/1997 | Japan . |

*Primary Examiner*—Terrence R. Till

[57] ABSTRACT

A remote control apparatus with a cleaning mechanism comprises a controller accommodated in a housing and a cleaning device assembled to the housing. The user holds the apparatus and makes a selection so as to remotely control the electric appliance. The cleaning device outwardly extends from the housing. The user rubs the surface of the electric appliance with the cleaning device pressed against the electric appliance, thereby cleaning the surface of the electric appliance. The cleaning device includes a cleaning element and an extend-retract mechanism. The cleaning element may be a brush, a sheet of cloth, or belt of cloth. The extend-retract mechanism causes the cleaning element to move to an operative position where the cleaning element is extended for cleaning the electric appliance and to a non-operative position where the cleaning element is retracted into the housing.

18 Claims, 10 Drawing Sheets

REMOTE CONTROL APPARATUS WITH A CLEANING MECHANISM

BACKGROUND OF THE INVENTION

1. Field of the Invention

The present invention relates to a remote control apparatus with a cleaning mechanism which is used to clean, for example, front panel of an electric appliance.

2. Description of Related Art

Conventionally, various cleaning tools such as a vacuum cleaner, chemical cloths, or an exclusive brush are used to remove dirt and debris from household electric appliances such as television receivers and VCRs.

Accessories of household electric appliances often include remote control apparatuses.

FIGS. 11A–11B are perspective views of one such conventional remote control apparatus, FIG. 11A showing the operating panel of the apparatus and FIG. 11B showing the rear side of the apparatus.

Referring to FIGS. 11A and 11B, a light emitting section 2 and a control panel 4 are arranged on a case 1. The light emitting section 2 emits a control signal (light signal) for remote-controlling the electric appliance. The control panel 4 includes a plurality of buttons 3 for a user to make a selection from a plurality of functions. The case 1 houses a control signal generator, not shown, and batteries for driving the control signal generator. The batteries are located behind a lid 5.

Household vacuum cleaners are designed to clean, for example, floor and carpet in the room and are therefore not suitable for cleaning, for example, a television receiver whose front panel includes complex curves surfaces and many buttons for switches. Brushes may be a cleaning tool most suitable for cleaning electric appliances. However, household electric appliances are usually not sold with brushes. A general purpose brush is usually stored in the house, away from the electric appliance in the house. It is cumbersome to bring the brush from the storage space every time the electric appliance is cleaned.

Miniature brushes and vacuum cleaners are commercially available but they are not quite portable in cleaning electric appliances. Besides, they have to be bought separately from electric appliances.

If the electric appliances are cleaned less frequently, the dust and dirt will accumulate thereon and the accumulated dirt is difficult to remove. The accumulated dirt prevents the normal operation of the electric appliance.

SUMMARY OF THE INVENTION

The present invention was made in view of the aforementioned drawbacks.

An object of the invention is to provide a remote control apparatus having a cleaning mechanism which is suitable for easy, simple cleaning of electric appliances.

A remote control apparatus comprises a controller accommodated in a housing and a cleaning means assembled to the housing. The controller remotely controls the electric appliance and the cleaning means outwardly extends from the housing. The user holds the apparatus and makes a selection. The user rubs the surface of the electric appliance with the cleaning means pressed against the electric appliance, thereby cleaning the surface of the electric appliance. The cleaning means includes a cleaning element and an extend-retract mechanism. The cleaning element may be a brush or a sheet of cloth.

If the cleaning element is a brush, the extend-retract mechanism slides or pivots to an operative position for extending the brush outwardly of the housing when cleaning the electric appliance and to a non-operative position for retracting the brush into the housing when not cleaning.

If the cleaning element is a sheet of cloth, the extend-retract mechanism further includes a supply bobbin and takeup bobbin. The sheet of cloth is wrapped at one longitudinal end thereof around the supply bobbin and at the other longitudinal end thereof around the takeup bobbin. The supply bobbin and takeup bobbin each include a thumbwheel which is operated by the user to rotate the supply bobbin and takeup bobbin, thereby advancing the cloth form the supply bobbin to the takeup bobbin. A locking mechanism urges the cloth against the supply bobbin and takeup bobbin, thereby preventing the supply bobbin and takeup bobbin.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Remote control apparatuses having a cleaning mechanism according to the present invention may be used as a remote control apparatus for use with electric appliances such as television receivers and VCRs. Preferred embodiments of the invention will be described in detail with reference to the accompanying drawings.

First embodiment

Figure 1:
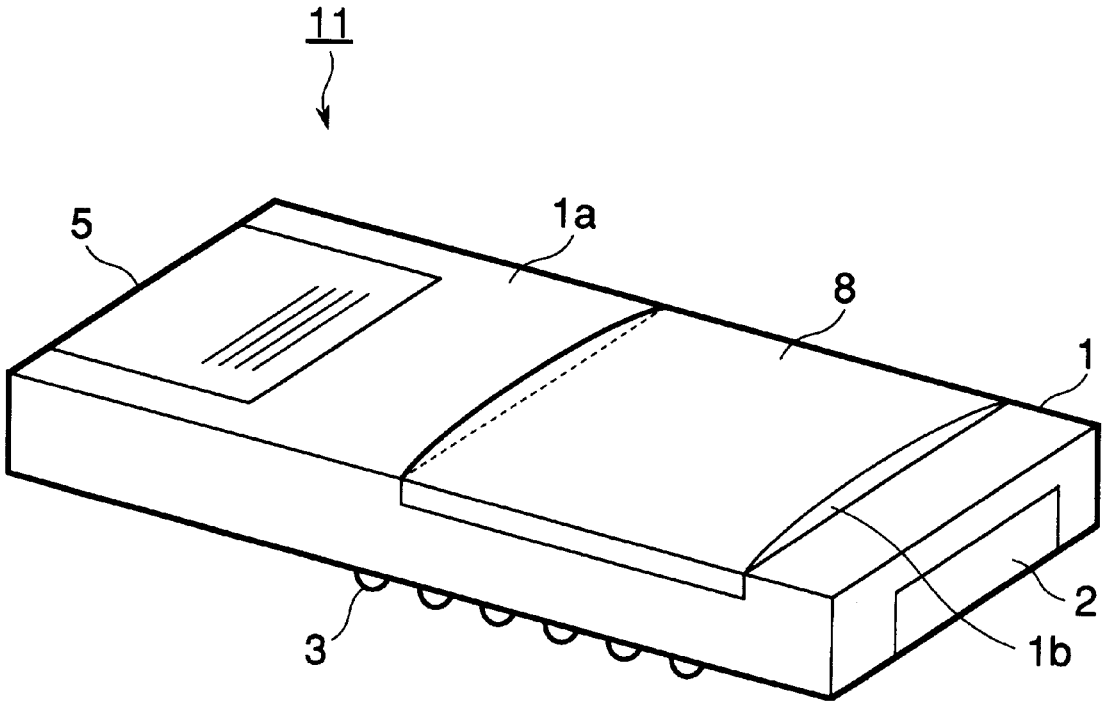
FIG. 1 is a perspective view of a first embodiment of the invention.

FIG. 1 is a perspective view of a first embodiment of the invention.

Referring to FIG. 1, a case 1 has a window 2 at one longitudinal end thereof. A light signal is transmitted through the window 2 in order to remotely control an electric appliance. Arranged on the front side of the case 1 are operating buttons 3 for a user to make a selection from among a variety of functions. A battery room is located on the rear side 1*a* of the case 1 and is closed with a lid 5. The rear side 1*a* has an extending area 1*b* on which a cleaning element 8 made of an attracting material, e.g., a sheet of cloth. The cleaning element 8 may also be made of other material such as sponge or brush.

Using the aforementioned cleaning element 8 provided on the remote control apparatus 11, the front panel of the electric appliance may be cleaned easily whenever necessary. A remote control apparatus for an electric appliance such as a television receiver is one of the most frequently used accessories, and is therefore always left near the appliance or the viewer. Thus, providing a cleaning element on the remote control apparatus allows the user to easily clean the screen surface and cabinet of, for example, a television receiver while watching television. Thus, the cleaning element on the remote control apparatus serves as a readily available, simple, and handy cleaner, which can be used to keep the electric appliance clean all the time. This type of cleaning element is more useful than known cleaners.

Second embodiment

Figure 2A:
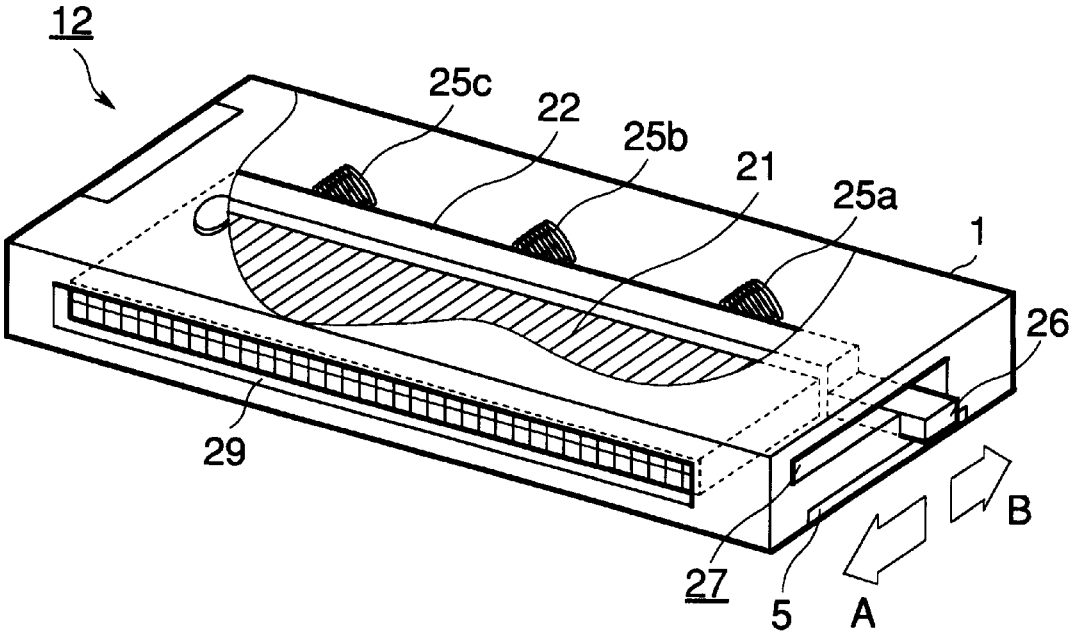
FIGS. 2A and 2B are perspective views, with partially cut-away views, of a second embodiment of the invention.
Figure 2B:
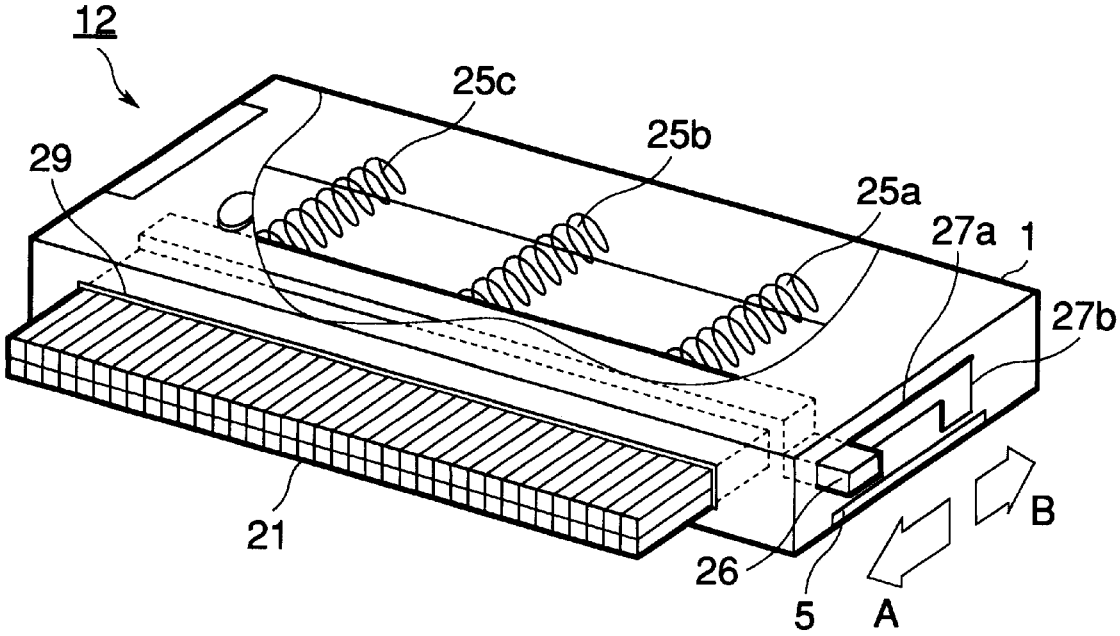

FIGS. 2A and 2B are perspective views, with partially cut-away views, of a second embodiment of the invention, showing a mechanism for retracting/extending a cleaning element 21. FIG. 2A shows the mechanism when the cleaning element 21 is retracted and FIG. 2B shows the mechanism when the cleaning element 21 is extended.

The second embodiment differs from the first embodiment in that the cleaning element is a brush 21 adapted to be retracted into and extended outwardly from the case 1. The rest of the construction is substantially the same as that of the first embodiment.

Referring to FIGS. 2A and 2B, the brush 21 is mounted to a base 22. The brush 21 extends laterally on one side of the longitudinally extending base 22 and compression springs 25*a*–25*c* are mounted on the other side. The base 22 has a knob 26 formed at its one longitudinal end. The knob 26 projects outwardly of the case 1 through an elongated hole 27 formed in the longitudinal end of the case 1 near the lid 5 of the battery room.

The hole 27 is generally L-shaped with an elongated hole 27*a* and a short hole 27*b*. The knob 26 is adapted to move within the elongated hole 27*a* and is engaged with a short hole 27*b* when the brush is fully retracted. The case 1 is formed with a slit 29 through which the brush 21 is extended and retracted.

When the knob 26 shown in FIG. 2A is lifted upward with respect to the short hole 27*b*, the knob 26 moves out of engagement with the short hole 27*b*. Then, the compression springs 25*a*–25*c* pushes the base 22 in a direction shown by arrow A till the knob 26 abuts the end of the elongated hole 27*a*. The brush 21 projects outwardly of the case 1 through the slit 29 as shown in FIG. 2B and is held in position. When the knob 26 is moved fully in a direction shown by arrow B, the compression springs 25*a*–25*c* are fully compressed so that the brush 21 is completely housed in the case 1 as shown in FIG. 2A.

According to the second embodiment, the cleaning element or brush 21 is adapted to extend from and retract into the case 1. The brush 21 projects outwardly from the case 1 only when the electric appliance is to be cleaned. When not cleaning, the brush 21 is completely retracted into the case 1 so that the brush 21 is not an obstacle to the remote control operation.

The three springs 25*a*–25*c* always urge the base 22 in the direction shown by arrow A when the brush 21 projects outwardly of the case 1, thereby ensuring the projection of the brush 21. While the springs 25*a*–25*c* are not essential for the brush to be extended from and retracted into the case 1, some urging member should be used for easy handling of the cleaning element. Although not depicted in the figures, a lid may be provided to close the slit 29 and to lock the brush 21 when brush is completely retracted.

Third embodiment

Figure 3A:
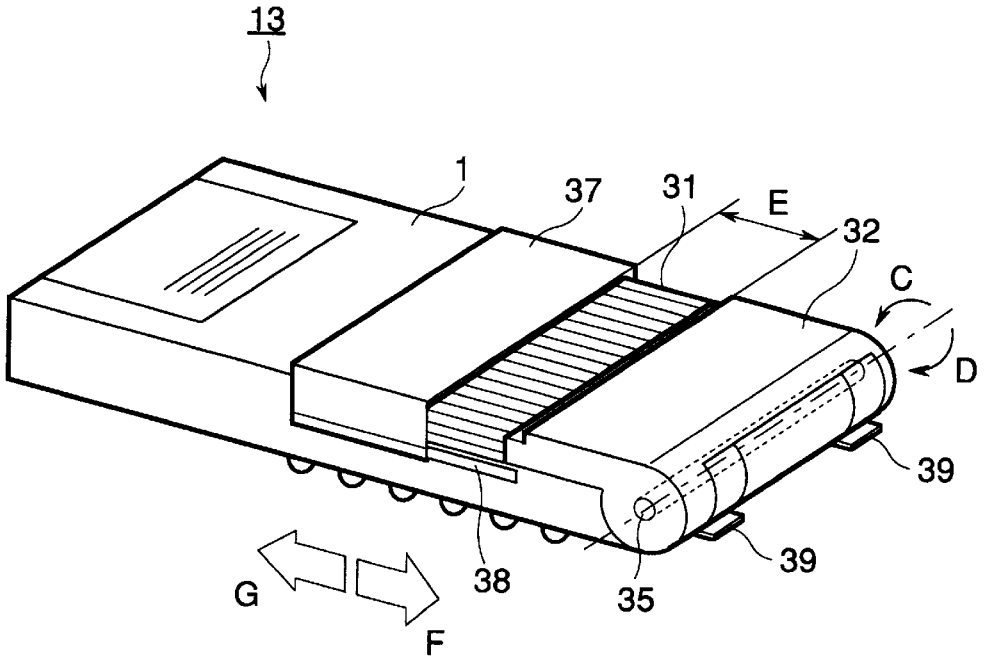
FIG. 3A illustrates the remote control apparatus of the second embodiment when the brush is not in use.
Figure 3B:
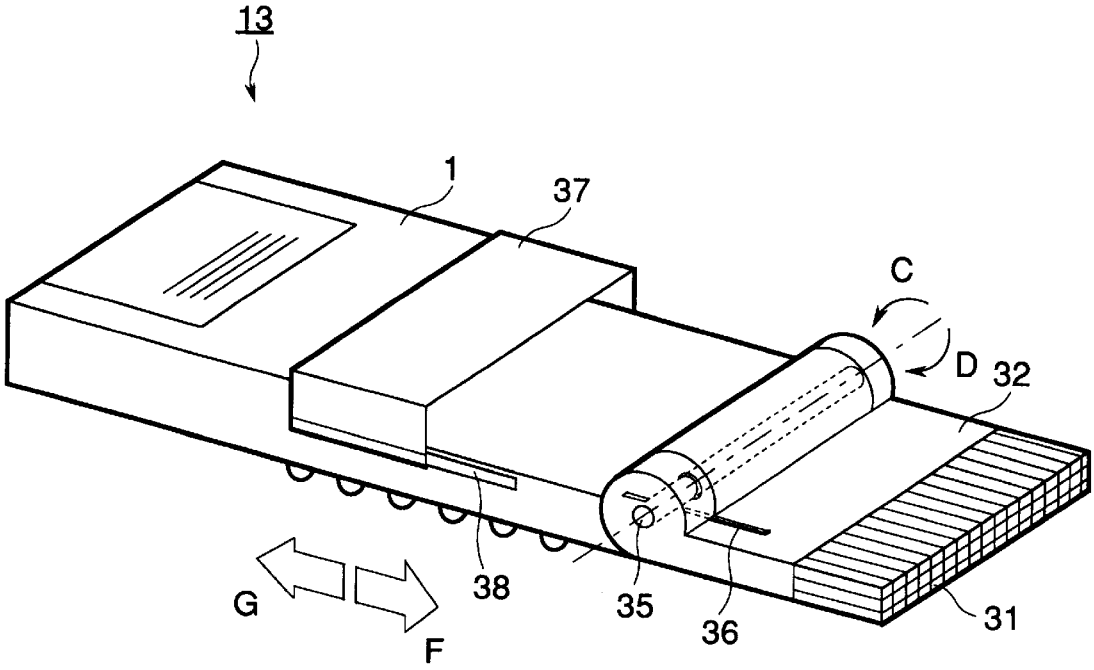
FIG. 3B illustrates the remote control apparatus of the second embodiment when the brush is in use.
Figure 4A:
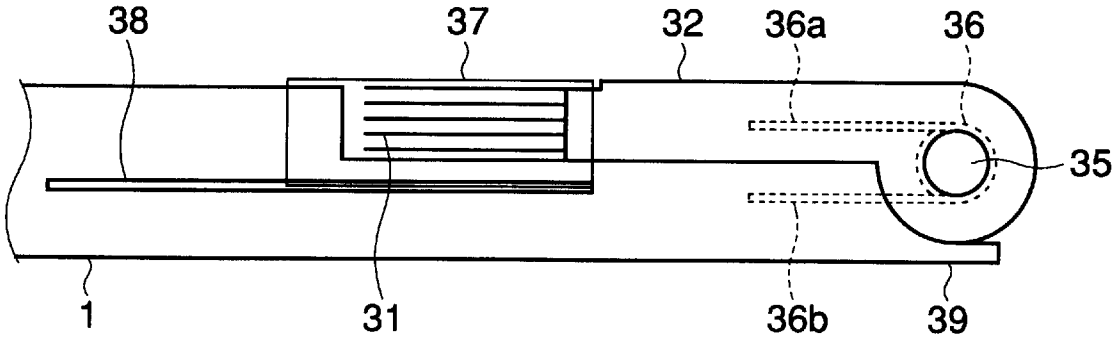
FIG. 4A is a side view of a third embodiment, showing the support when the brush is not used.
Figure 4B:
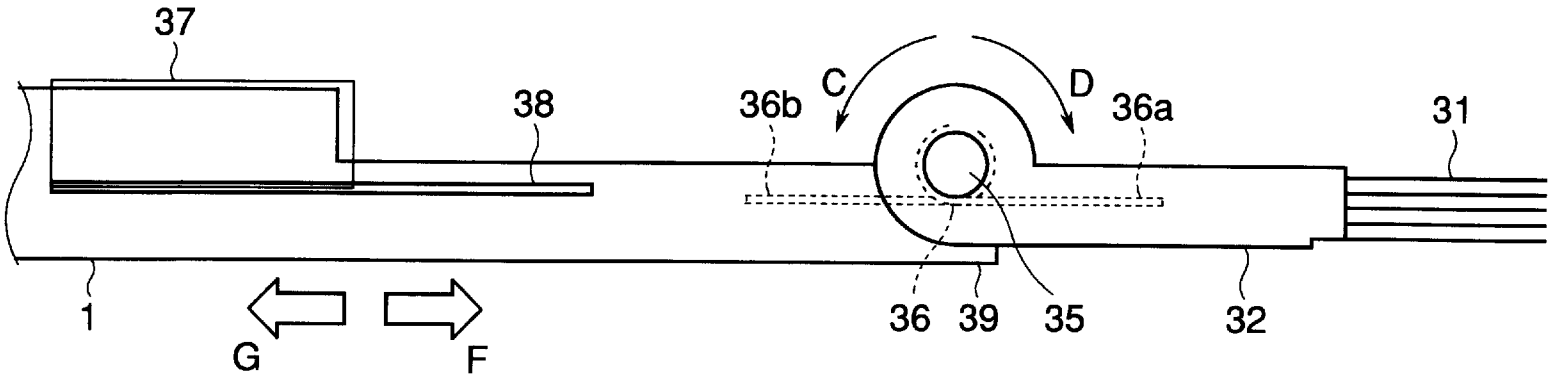
FIG. 4B is a side view of the third embodiment, showing the support when the brush is used.

FIGS. 3A and 3B are perspective views of a third embodiment. FIGS. 4A and 4B are side views illustrating an enlarged part of the brush as a cleaning means. The third embodiment differs from the first embodiment in that the cleaning element is pivotal with respect to the case 1 and a drive mechanism causes the cleaning element to pivot between an extended position (operative position) and a retracted position (non-operative position).

Referring to FIGS. 3A and 3B, the cleaning element or brush 31 is securely mounted to a support 32 which is pivotally assembled to the case 1 using a pin 35. The support 32 is pivotal about the pin 35 in directions shown by arrows C and D. FIG. 3A illustrates the remote control apparatus when the brush 31 is not in use and FIG. 3B illustrates the remote control apparatus when the brush 31 is in use.

FIG. 4A is a side view showing the support 32 when the brush 31 is not used. FIG. 4B is a side view showing the support 32 when the brush 31 is used. As shown in FIG. 4A, the pin 35 extends through a torsion spring 36 whose one end 36*a* engages the support 32 and the other end 36*b* engages the case 1, so that the support 32 is always urged by the torsion spring 36 in such a direction as to pivot in the direction shown by arrow D.

A sliding door type locking cover 37 slides in guide grooves 38 over a distance E in a direction shown by arrow G to release the brush 21 and in a direction shown by arrow F to lock the brush 21, preventing the brush 21 from popping out from the remote control apparatus 13.

Tabs 39 are provided on longitudinal end of the case 1 near the pin 35 and project in the direction shown by arrow F. The tabs 39 abut the support 32 when the support 32 is pivoted in the direction shown by arrow D, preventing the support 32 from further pivoting in the direction.

As is described above, when cleaning the electric appliance, the locking cover 37 is slid in the direction shown by arrow G so that the brush 31 projects in the longitudinal direction of the remote control apparatus. When not cleaning, the brush 31 and support 32 are fully pivoted in the direction shown by arrow C and then the locking cover 37 is slid in the direction shown by arrow F, thereby holding the brush in the case 1.

While the torsion spring 36 is advantageous to facilitate the pivotal motion of the brush 31 and hold the brush 31 in position, the torsion spring 36 is not essential.

Fourth embodiment

Figure 5:
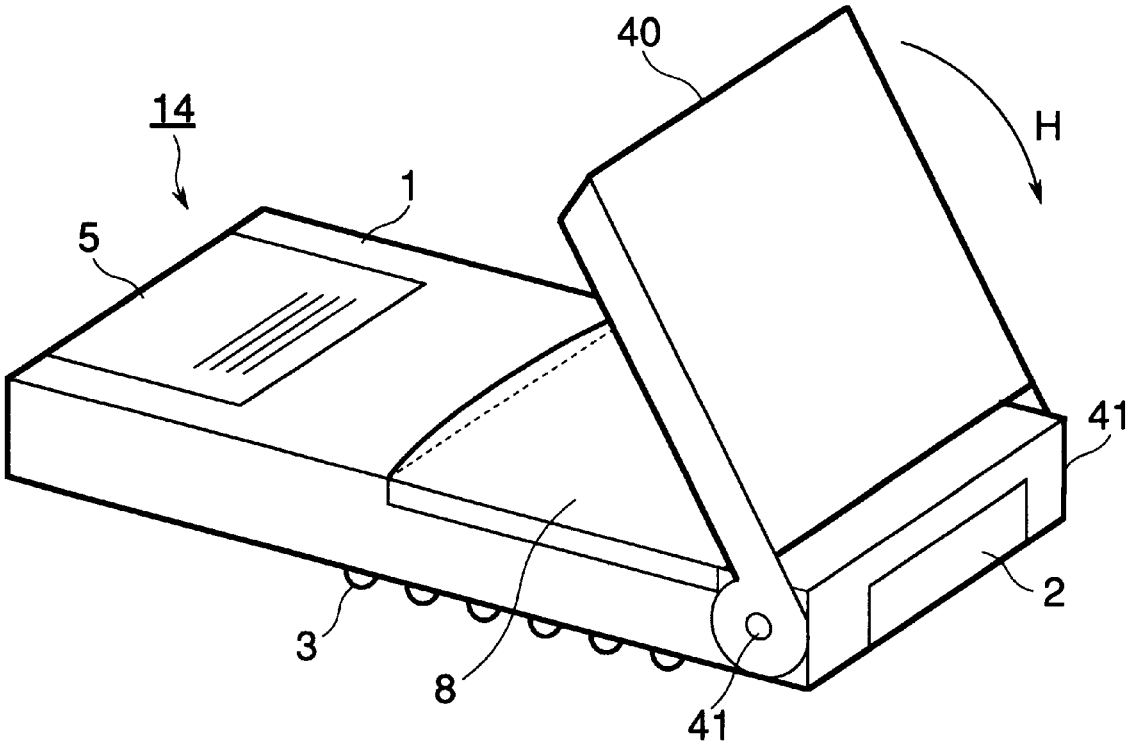
FIG. 5 is a perspective view, illustrating a fourth embodiment of the invention.

FIG. 5 is a perspective view illustrating a fourth embodiment of the invention. A remote control apparatus 14 is provided with a sheet-like attracting member 8 as a cleaning element disposed on the rear surface of the case 1. The attracting member 8 is a sheet of cloth which is on the back side of the apparatus and serves as a cleaning element and is covered with a cover 40 when not cleaning the electric appliance. The rest of the construction is the same as that of the first embodiment and description thereof is omitted.

The cover 40 is pivotally supported such that the cover 40 is pivotal about projections 41 near the light emitting section of the case 1. The cover 40 fits to the case 1 when closed.

When remotely controlling the electric appliance, the cover 40 is closed to hide the attracting member 8, thereby preventing the user from touching any parts of the attracting member 8 stained with dust, oil, and the like. In order to expose the attracting member 8 prior to the cleaning operation of the electric appliance, it is only necessary that the cover 40 is opened in a direction shown by arrow H. The fourth embodiment allows as easy cleaning operation as in the first embodiment whenever necessary.

Fifth embodiment

Figure 6A:
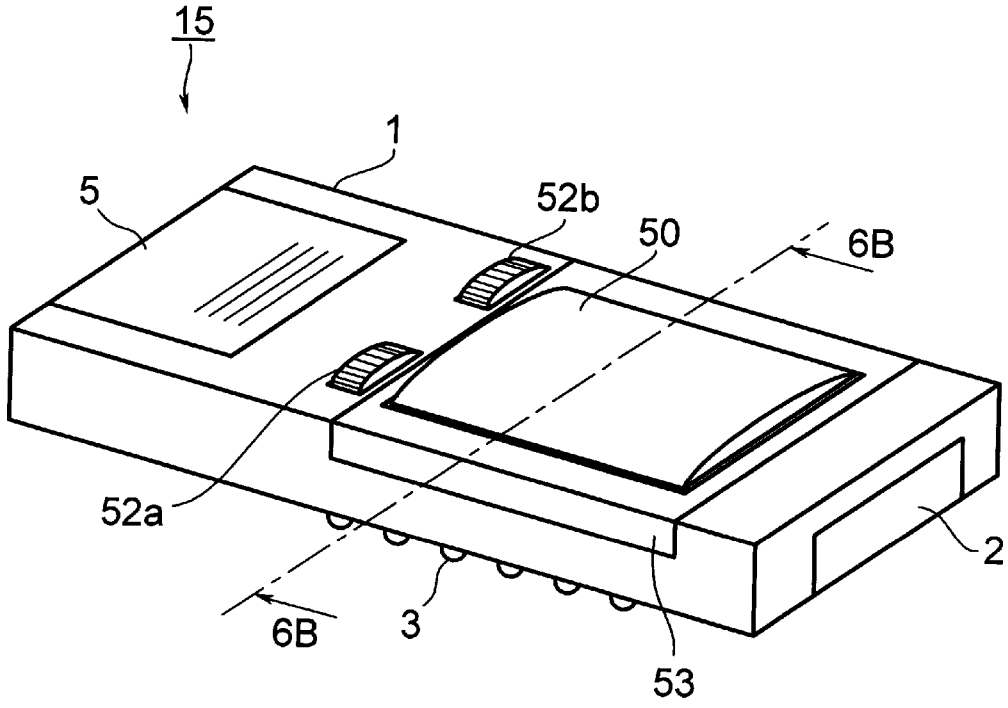
FIG. 6A is a perspective view of a remote control apparatus with a cleaning mechanism according to a fifth embodiment.
Figure 6B:
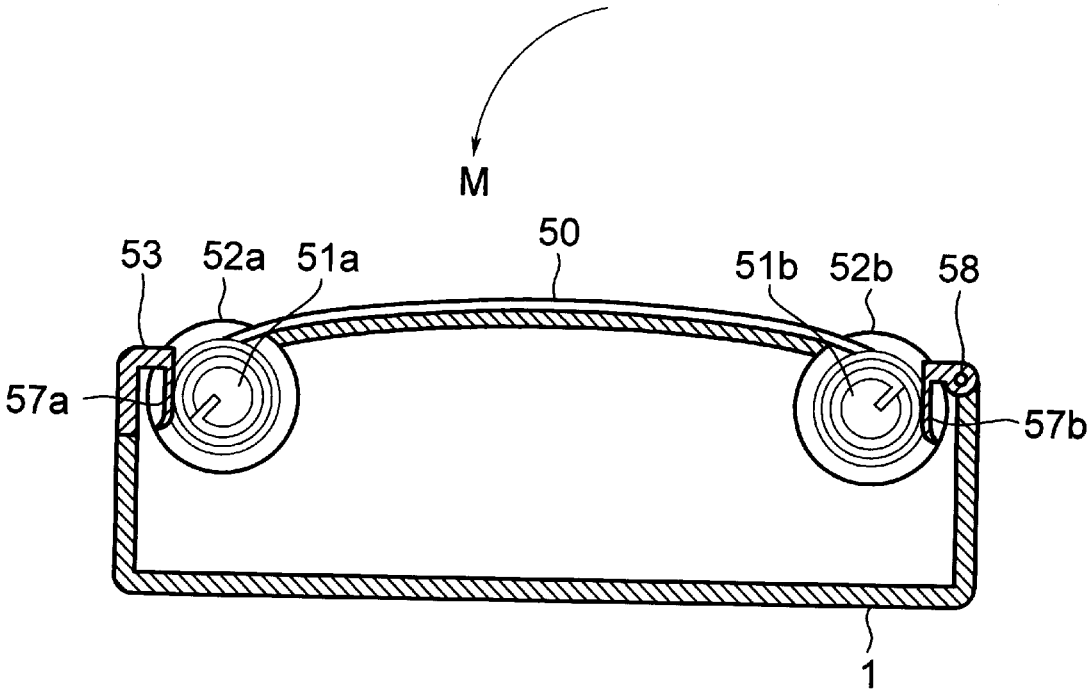
FIG. 6B is a cross-sectional view taken along the lines K—K of FIG. 6A.

FIG. 6A is a perspective view of a remote control apparatus 15 having a cleaning mechanism according to a fifth embodiment and FIG. 6B is a cross-sectional view taken along the lines K–K of FIG. 6A. In the remote control apparatus 15 of the fifth embodiment, the cleaning element is in the shape of an elongated, sufficiently wide belt. Unlike the first embodiment, the cleaning element is not secured on the outer surface of the case 1 but wrapped around a supply bobbin and takeup bobbin accommodated in the case 1.

Referring to FIGS. 6A and 6B, a supply bobbin 51*a* and a takeup bobbin 51*b* are provided on the underside of a cover 53 and disposed at transversely opposing ends of the case 1. The cover 53 is formed with two opposing slits through which a belt-like attracting member runs over a front wall of the cover 53 outwardly extending from the cover 53. The belt-like attracting member 50 is wrapped at one end portion thereof around the supply bobbin 51*a* and at the other end portion around the takeup bobbin 51*b*. An unused, clean part of the attracting member 50 is exposed on the extending surface of the cover 53.

Flat springs 57*a* and 57*b* are in one piece construction with the cover 53 and urge the attracting member 50 against the supply bobbin 51*a* and takeup bobbin 51*b* so as to prevent the supply bobbin 51*a* and takeup bobbin 51*b* from free rotation and hold the belt-like attracting member 50 taut. The cover 53 is formed with holes 58 therein into which projections on the case 1 extend, so that the cover 53 is pivotally supported to the case 1.

When cleaning the electric appliance, the user holds the remote control apparatus 15 in his/her hand and presses the attracting member 50 against the panel surface of the appliance, and then rubs the panel surface with the attracting member 50. After cleaning, the user operates thumbwheel 52*b* to rotate so that the portion of the attracting member 50 to which dust and oil or the like has been attracted is taken up around the takeup bobbin 51*b*. This construction allows the user to wrap the stained portion of the attracting member 50 around the takeup bobbin 51*b* and expose an unused, clean part of the attracting member 50, thus preventing the user from touching the attracting member 50 stained with dust, oil and the like when operating the remote control apparatus 15 to make a selection.

The springs 57*a* and 57*b* hold the supply bobbins 51*a* and takeup bobbin 51*b* in positions with respect to the case 1, so that the attracting member 50 will not move back from takeup bobbin 51*b* to the supply bobbin 51*a*. This prevents the attracting member 50 from having a slack therein. Urging means such as the springs 57*a* and 57*b* is not essential in advancing the attracting member from the supply bobbin 51*a* to the takeup bobbin 51*b*, but is preferred in preventing the attracting member 50 from moving in the reverse direction and eliminating any slack in the attracting member 50. The urging means allows reliable advancement of the attracting member 50 from the supply bobbin 51*a* to the takeup bobbin 51*b*.

The cover 53 is mounted to the case 1 in such a way that the cover 53 can pivot to open and close with respect to the case 1. The attracting member 50 together with the bobbins 51*a* and 51*b* are received in the case 1 when the cover 53 is closed, and are exposed and accessible when the cover 53 is opened. This construction facilitates disassembly of the attracting member 50 and the bobbins 51*a* and 51*b* from the remote control apparatus 15 when washing and/or replacing the cleaning element and bobbins.

Sixth embodiment

Figure 7A:
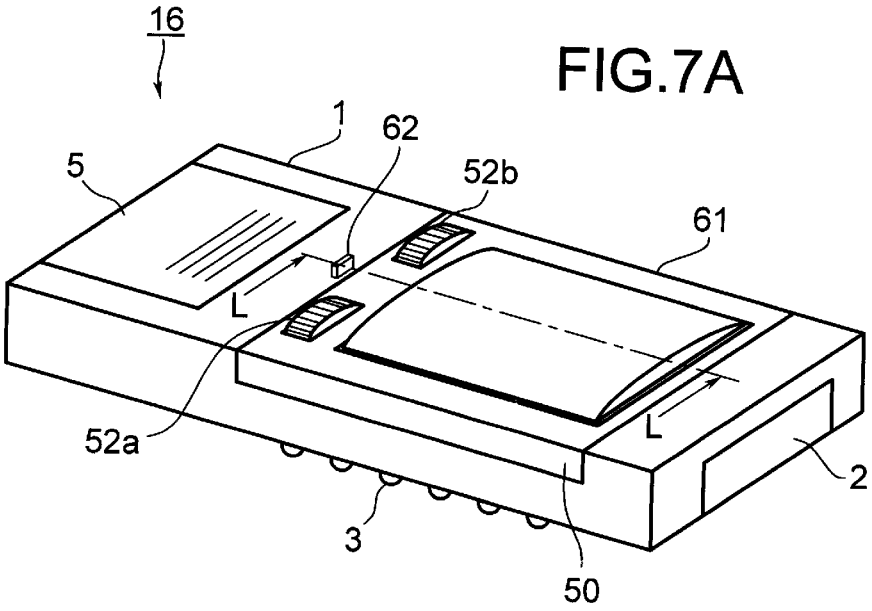
FIGS. 7A and 7B show the remote control apparatus according to a sixth embodiment.
Figure 7B:
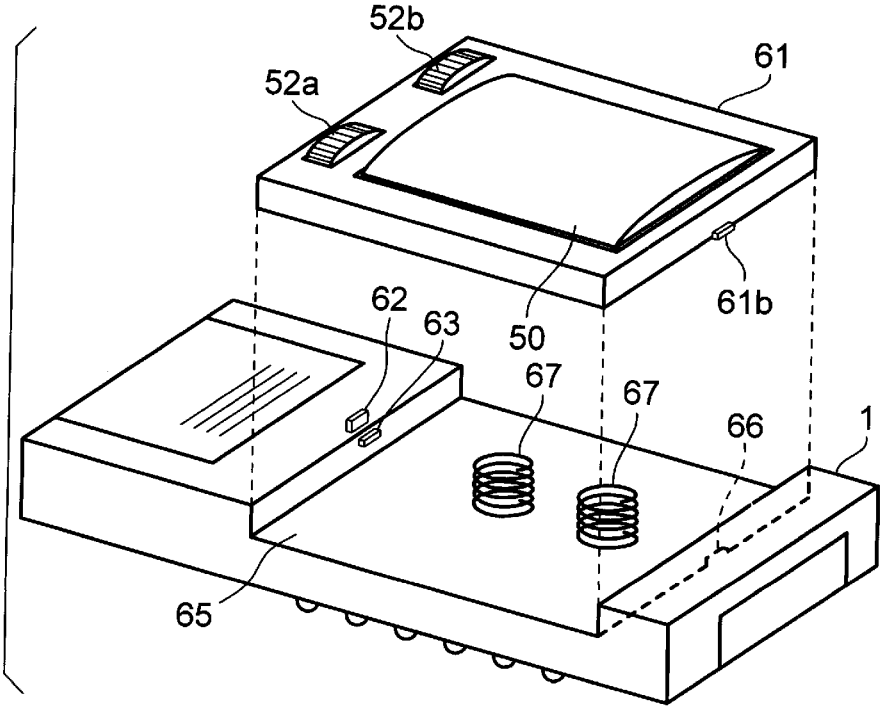

FIGS. 7A and 7B are perspective views illustrating a sixth embodiment. In the sixth embodiment, a cleaning mechanism is adapted to be detachably assembled to the remote control apparatus 16. The rest of the construction is the same as the fifth embodiment and description thereof is omitted.

A long, sufficiently wide belt-like attracting member 50, supply bobbin 51*a*, takeup bobbin 51*b*, and thumbwheels 52*a* and 52*b* are all housed in a case 61. The case 61 is detachably mounted to the case 1 of the remote control apparatus 16.

Figure 8:
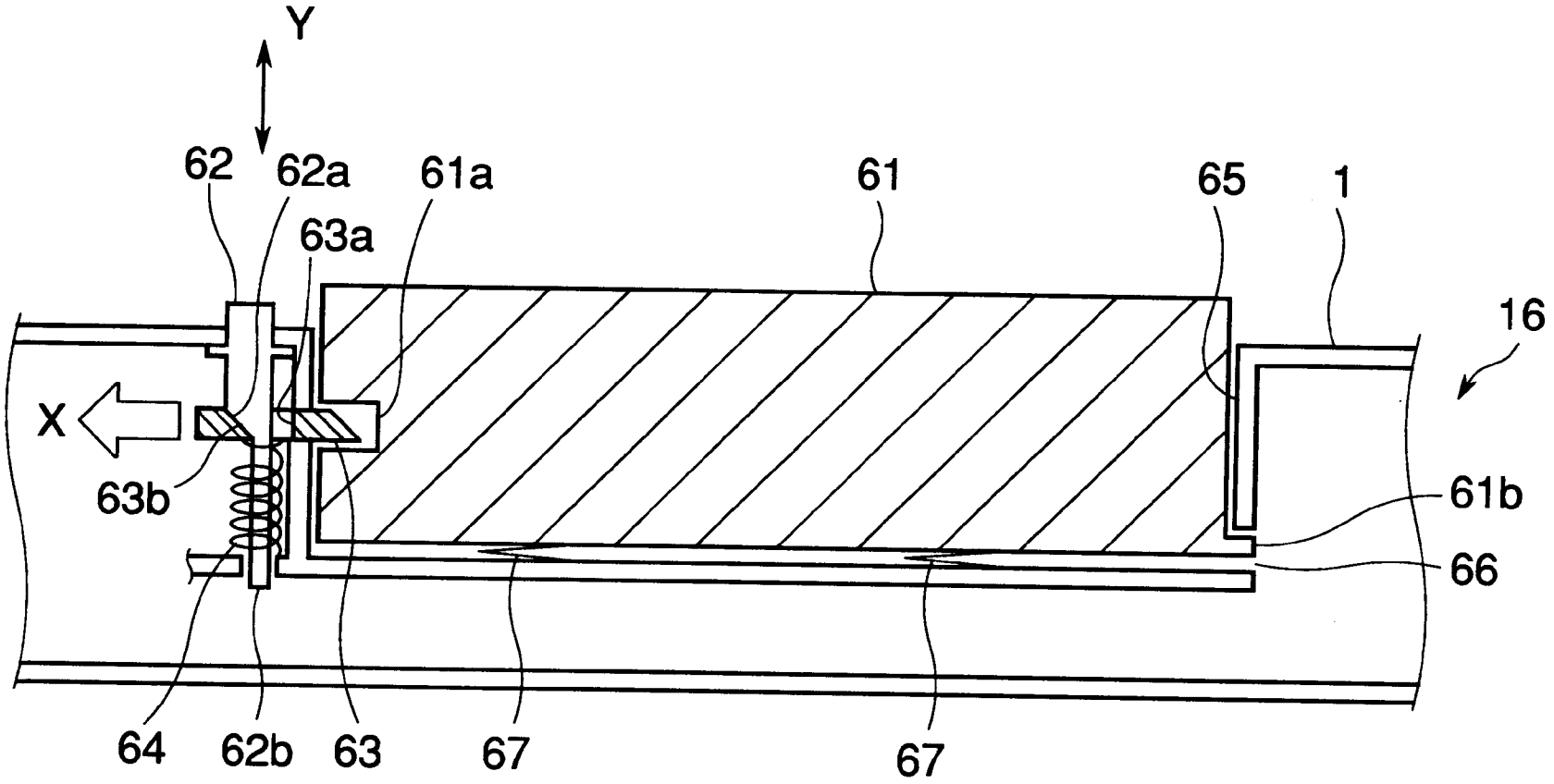
FIG. 8 is a cross-sectional view taken along the lines L—L of FIG. 7A, showing a relevant construction for securing the case 61 to the remote control apparatus.

FIG. 8 is a cross-sectional view taken along the lines L—L showing a relevant construction in which the case 61 is installed to the remote control apparatus 16. The case 61 houses a cleaning mechanism therein and serves as a cleaning unit. The case 61 is securely received in a recess 65 of the remote control apparatus 16.

Referring to FIG. 8, the button 62 is slidable in a direction shown by arrow Y. The button 62 extends through a hole 63*a* formed in a locking member 63. The locking member 63 extends in a direction perpendicular to arrow Y. The button 62 is formed with a beveled surface 62*a* in the middle thereof which is in slidable contact with a beveled surface 63*b* of the locking member complimentary to the beveled surface 62*a*. The button 62 has a narrow longitudinal portion 62*b* in one piece construction with the button 62. The longitudinal portion 62*b* extends through a coil spring 64.

The recess 65 in the case 1 is formed with a hole 66 in the wall thereof near its bottom portion. The case 61 is formed with a recess 61*a* in one side thereof and a projection 61*b* on the opposite side. The case 61 is urged upwardly by coil springs 67 mounted on the bottom of the recess 65 in the case 1, thereby being securely held in position.

When the case 61 is to be loaded into the remote control apparatus 16, the button 62 is pushed down into the case 1. Upon pushing down the button 62, the locking means 63 is retracted into the case 1 so that the case 61 may be comfortably introduced into the recess 65. After the case 61 has been completely received in the cress 65, the button 62 is released, thereby locking the case 61 to the case 1.

FIG. 7A shows the remote control apparatus 16 when the case 61 is received in the recess 65 and the locking member 63 extends into the recess 61*a* in the case 61. When the button 62 is pushed down into the case 1, the locking member 63 is moved in a direction shown by arrow X (FIG. 8), disengaging from the recess 61*a*. With the locking member 63 disengaged from the recess 61*a*, the case 61 is lifted at one end thereof from the case 1 so that the projection 61*b* moves out of the hole 66.

The cleaning mechanism housed in the case 61 is of the same construction as that of the fifth embodiment. The case 61 can easily be taken out from the case 61. This allows easy handling of the cleaning mechanism when cleaning the electric appliance and replacing the attracting member 50.

The coil springs 67 urge the case 61 to firmly hold the case 61 in position with respect to the case 1. This construction facilitates the assembly of the cleaning mechanism to the case 1 and the disassembly of the cleaning mechanism from the case 1. The springs 67 are not essential though they are effective in holding the case 61.

Seventh embodiment

Figure 9:
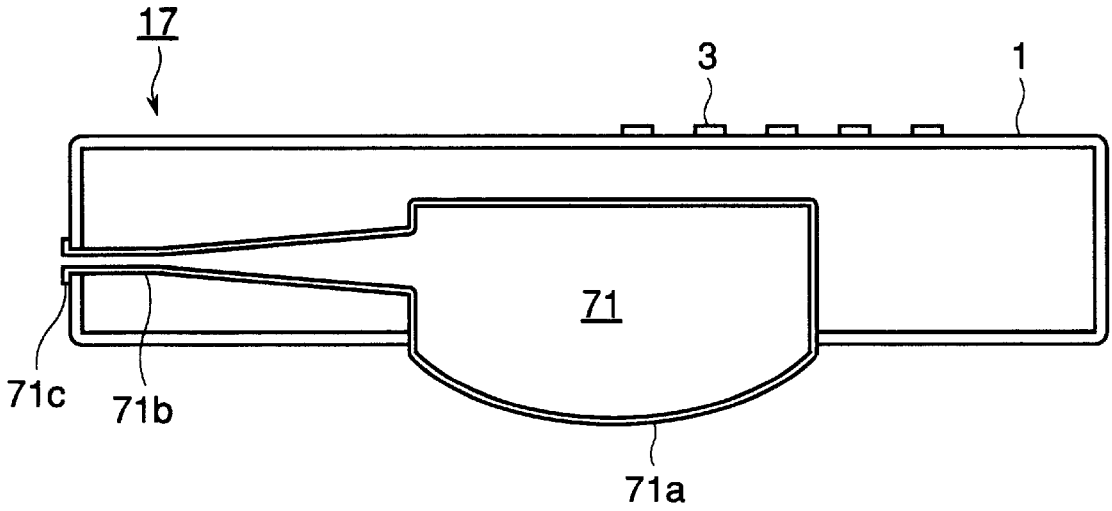
FIG. 9 is a cross-sectional side view, showing a relevant portion of a seventh embodiment.

FIG. 9 is a cross-sectional side view showing a relevant portion of a seventh embodiment. A remote control apparatus 17 having a cleaning mechanism is provided with an air tank 71 in the form of a short cylinder with a top wall 71*a* which outwardly extends from the rear side of the case 1. The air tank 71 includes a duct 71*b* and a nozzle 71*c* that opens to the outer surface of the case 1.

Pushing the top wall 71*a* from outside causes the air in the air tank 71 to be pressurized. When cleaning the electric appliance, the user aims the nozzle 71*c* at the dust on the electric appliance and pushes the top wall 71*a* strongly. The pressurized air is then ejected via the duct 71*b* through the nozzle 71*c*, blowing the dust away from the surface of the electric appliance.

If the nozzle 71*c* is made narrow and formed to project outwardly from the case 1, the nozzle 71*c* is effective in blowing out the dust in small gaps in the electric appliance.

Eighth embodiment

A remote control apparatus of an eighth embodiment has an air-sucking mechanism in place of the air tank 71 of the seventh embodiment. In the eighth embodiment, a dust-collecting bag is provided and the air-sucking mechanism is connected to communicate with the dust-collecting bag so that the dust sucked is collected in the bag. The dust-collecting bag may be detachably mounted.

Ninth embodiment

Figure 10:
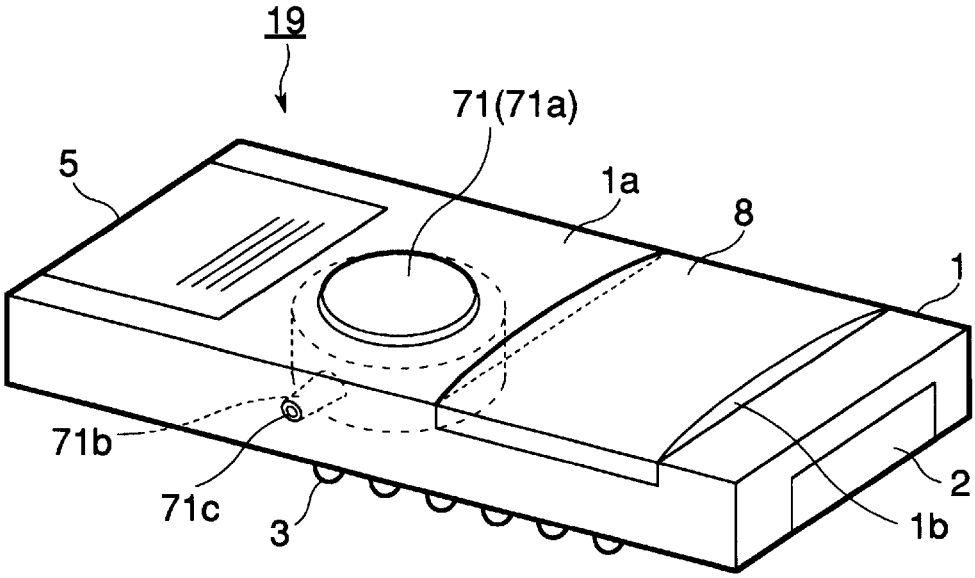
FIG. 10 is a perspective view of a remote control apparatus according to a ninth embodiment.
Figure 11A:
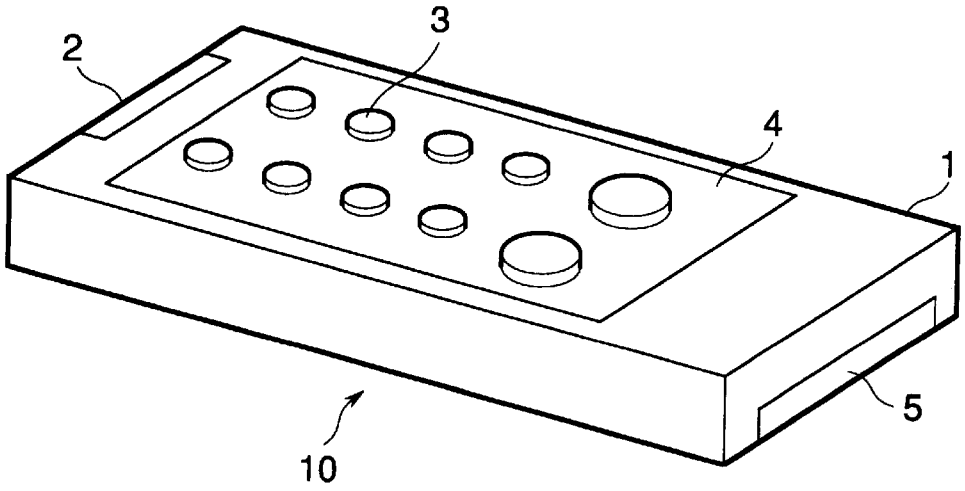
FIG.11A CONVENTIONAL ART
FIGS. 11A–11B are perspective views of one such conventional remote control apparatus, FIG. 11A showing the operating panel of the apparatus and FIG. 11B showing the rear side of the apparatus.
Figure 11B:
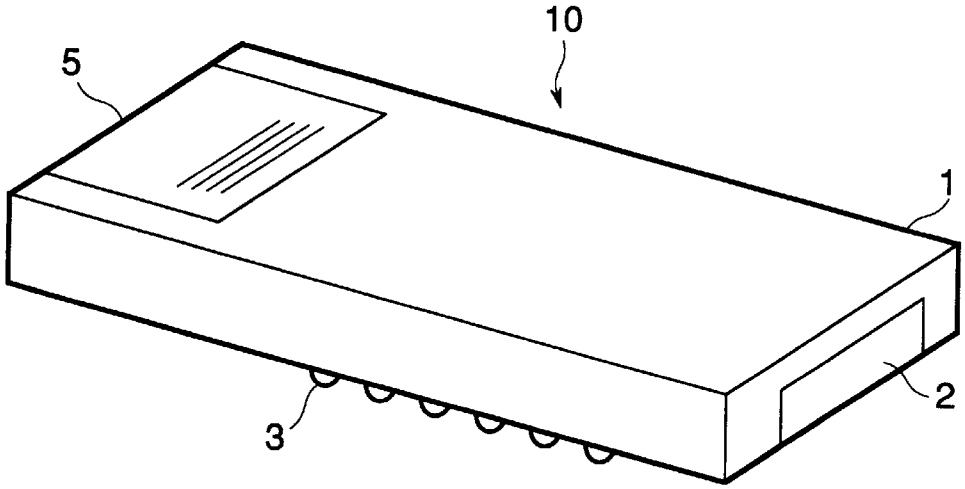
FIG.11B CONVENTIONAL ART

FIG. 10 is a perspective view of a remote control apparatus 19 according to a ninth embodiment. The apparatus 19 is provided with a cleaning means which includes an attracting member 8 of the first embodiment and an air tank 71 of the seventh embodiment. In FIG. 10, elements corresponding to those in FIGS. 1 and 9 have been given the same references and description thereof is omitted.

The electric appliance may be easily cleaned using the attracting member 8 extending outwardly from the case 1 of the remote control apparatus 19. Further, the nozzle 71*c* of the air tank may be aimed at the electric appliance and the air is blown against thereat, thereby removing the dust from the electric appliance.

While the attracting member 8 of the first embodiment and the air tank of the seventh embodiment are used in combination, any one of sheet-like attracting member 8 and brush 21 may be used in combination with any one of air tank and air sucking mechanism.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A remote control apparatus with a cleaning mechanism, comprising:

a controller, remotely controlling an electric appliance;

a housing in which said controller is housed; and a cleaning means, cleaning the electric appliance, said cleaning means outwardly extending from said housing.

2. The remote control apparatus according to claim 1, wherein said cleaning means includes a cleaning element and an extend-retract mechanism, said extend-retract mechanism moving to a first position for extending the cleaning element outwardly of said housing when cleaning the electric appliance and to a second position for retracting the cleaning element into said housing when not cleaning the electric appliance.

3. The remote control apparatus according to claim 2, wherein said cleaning element is a brush.

4. The remote control apparatus according to claim 2, wherein said extend-retract mechanism pivots to the first position for extending the cleaning element and to the second position for retracting the cleaning element.

5. The remote control apparatus according to claim 4, wherein said extend-retract mechanism is urged toward the first position by an urging means.

6. The remote control apparatus according to claim 5, further comprising a cover slidably mounted to said housing, said cover sliding to a third position to cover the cleaning element when said extend-retract mechanism is at the second position and sliding to a fourth position to allow said extend-retract mechanism to be at the first position.

7. The remote control apparatus according to claim 2, wherein said extend-retract mechanism slides to the first position for extending the cleaning element and to the second position for retracting the cleaning element.

8. The remote control apparatus according to claim 7, wherein said extend-retract mechanism is urged toward the first position by urging means.

9. The remote control apparatus according to claim 8, wherein said cleaning element is mounted on a base adapted to move along an elongated hole formed in said housing, said base moving against an urging force of the urging means to one end of the elongated hole to engage a part of said housing when said extend-retract mechanism moves to the second position and moving to the other end of the elongated hole to disengage said part of said housing when said extend-retract mechanism moves to the first position.

10. The remote control apparatus according to claim 1, wherein said cleaning element is a sheet-like attracting member.

11. The remote control apparatus according to claim 10, wherein said cleaning means further includes a supply bobbin and takeup bobbin, wherein the attracting member is elongated and is wrapped at one longitudinal end thereof around the supply bobbin and at the other longitudinal end thereof around the takeup bobbin.

12. The remote control apparatus according to claim 11, further including a first locking means, wherein said first locking means prevents the supply bobbin and takeup bobbin from rotating free so that the attracting cleaning member is held taut.

13. The remote control apparatus according to claim 12, wherein said first locking means is in pressure contact with the attracting cleaning member and urges the supply bobbin and the takeup bobbin.

14. The remote control apparatus according to claim 11, wherein said cleaning means further including thumbwheels for causing said supply bobbin and takeup bobbin to rotate.

15. The remote control apparatus according to claim 10, further including an air blowing means for blowing air against the electric appliance.

16. The remote control apparatus according to claim 1, wherein said cleaning means is in a unitary construction detachably mounted to said housing.

17. The remote control apparatus according to claim 16, wherein said housing has a locking means which detachably holds said unitary construction and urges said unitary construction in a direction away from said fousing.

18. The remote control apparatus according to claim 1, further including a cover mounted to said housing, said cover moving to a first position to cover the cleaning means when not cleaning the electric appliance and to a second position to expose the cleaning means when cleaning the electric appliance.

* * * * *